US006747403B2

(12) United States Patent
Spears

(10) Patent No.: US 6,747,403 B2
(45) Date of Patent: Jun. 8, 2004

(54) LAMP TUBE HAVING A UNIFORM LIGHTING PROFILE AND A MANUFACTURING METHOD THEREFOR

(75) Inventor: Kurt E. Spears, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 09/938,033

(22) Filed: Aug. 22, 2001

(65) Prior Publication Data

US 2003/0038584 A1 Feb. 27, 2003

(51) Int. Cl.[7] ..... H01J 1/62

(52) U.S. Cl. ..... 313/485; 313/484; 313/483; 313/635

(58) Field of Search ..... 313/483, 484, 313/485, 486, 487, 491, 635, 493

(56) References Cited

U.S. PATENT DOCUMENTS 5,856,726 A * 1/1999 Evans et al. ..... 313/491
5,998,921 A * 12/1999 Nakaya et al. ..... 313/491

FOREIGN PATENT DOCUMENTS

| | | | |
|---|---|---|---|
| EP | 0735570 | A2 | 10/1996 |
| JP | 560059426 | A | 5/1981 |
| JP | 010120756 | A | 5/1989 |
| JP | 090293484 | A | 11/1997 |
| JP | 2001023518 | | 1/2001 |

* cited by examiner

*Primary Examiner*—Ashok Patel
*Assistant Examiner*—Sharlene Leurig

(57) ABSTRACT

A method of treating a lamp tube having a first end and a second end comprising introducing a first quantity of a luminescent substance into the first end of the lamp tube and introducing a second quantity of a luminescent substance into the second end of the lamp tube is provided. An illumination source comprising a linear tube having a first end and a second end and an inner surface having a luminescent substance distributed thereon, a longitudinal distribution of the luminescent substance having a minimum at a first point of the inner surface and a luminescent substance density greater than the minimum at each of a second and third point of the inner surface, the first point longitudinally located between the second and third points, is provided.

6 Claims, 5 Drawing Sheets

LAMP TUBE HAVING A UNIFORM LIGHTING PROFILE AND A MANUFACTURING METHOD THEREFOR

TECHNICAL FIELD OF THE INVENTION

This invention relates to lamp tubes and, more particularly, to a lamp tube having a uniform lighting profile and to a treatment process for producing same.

BACKGROUND OF THE INVENTION

Optical scanners generate machine-readable image data representative of a scanned object such as an image on a paper document or other media. Flatbed optical scanners are stationary devices which have a transparent platen upon which the media or object to be scanned is placed. Equipment such as flat bed scanners, film scanners, copiers and some digital cameras may use a linear cold cathode fluorescent lamp (CCFL) as the light source. The media or object is scanned by sequentially imaging narrow strips or scan line portions of the media or object by an imaging apparatus such as a charge-coupled device (CCD). The imaging apparatus produces image data which is representative of each scan line portion of the scanned media or object. A linear arrangement of light sensitive elements, such as CCD photodetectors, is used to convert light into electric charges. There are many relatively low-priced color and black and white, one-dimensional array CCD photodetectors available for image scanning systems. Electronic imaging systems may alternatively use two-dimensional arrays of light sensitive elements such as CCD arrays. However, these arrays are expensive because they have low manufacturing yields. Linear photodetectors cost much less than array detectors because they are much smaller and have higher manufacturing yields.

While linear CCFLs are bright, inexpensive, and reliable, they also have one major disadvantage—they have a non-uniform illumination intensity profile that requires corrective analog or digital gain to normalize. These devices suffer from low signal-to-noise ratios at the ends of the scan lines due to decreased light intensity on the object or media and through the optical system.

SUMMARY OF THE INVENTION

In accordance with an embodiment of the present invention, a method of treating a lamp tube having a first end and a second end comprising introducing a first quantity of a luminescent substance into the first end of the lamp tube and introducing a second quantity of a luminescent substance into the second end of the lamp tube is provided.

In accordance with another embodiment of the present invention, an illumination source comprising a linear tube having a first end and a second end and an inner surface having a luminescent substance distributed thereon, a longitudinal distribution of the luminescent substance having a minimum at a first point of the inner surface and a luminescent substance density greater than the minimum at each of a second and third point of the inner surface, the first point longitudinally located between the second and third points, is provided.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

The preferred embodiment of the present invention and its advantages are best understood by referring to FIGS. 1 through 8 of the drawings, like numerals being used for like and corresponding parts of the various drawings.

Figure 1:
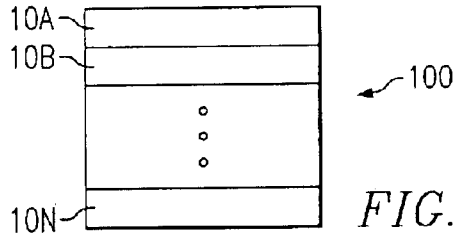
FIG. 1 is a diagram representing an embodiment of a scan media document that may be scanned by an imaging system according to the present invention.

In FIG. 1, there is illustrated a scan media, such as for example and not by way of limitation, a media 100 that may be scanned by an imaging system, for example a flatbed scanner, digital camera, copier, film scanner, or another device. The imaging system uses an illumination source, for example a linear cold cathode fluorescent lamp (CCFL) having phosphor, or another luminescent substance, excited by mercury molecules or another ultra-violet radiation source, to scan sequential scan line portions 10A–10N of media 100. Other types of lamps are commonly used in imaging devices, such as xenon lamps having phosphors excited by ultra-violet radiation from xenon molecules in the lamp tube. A scan line is illuminated with a CCFL with a plurality of focal points on each scan line. The totality of the light striking a particular focal point can be considered to originate from a finite number of point sources along the CCFL. The light that comes into focus on a focal point is generally passed through an image forming system, for example an image stabilizer, a filter, an optic system, a single lens, a holographic lens or another device. The light is then passed to a photodetector where it is converted to an electric charge. Generally, a plurality of electric charges are generated according to this technique for a given scan line. Once electric charges for a particular scan line have been produced, the charges for the next scan line are generated. This general procedure is repeated until all scan lines of media 100 have been imaged.

Figure 2:
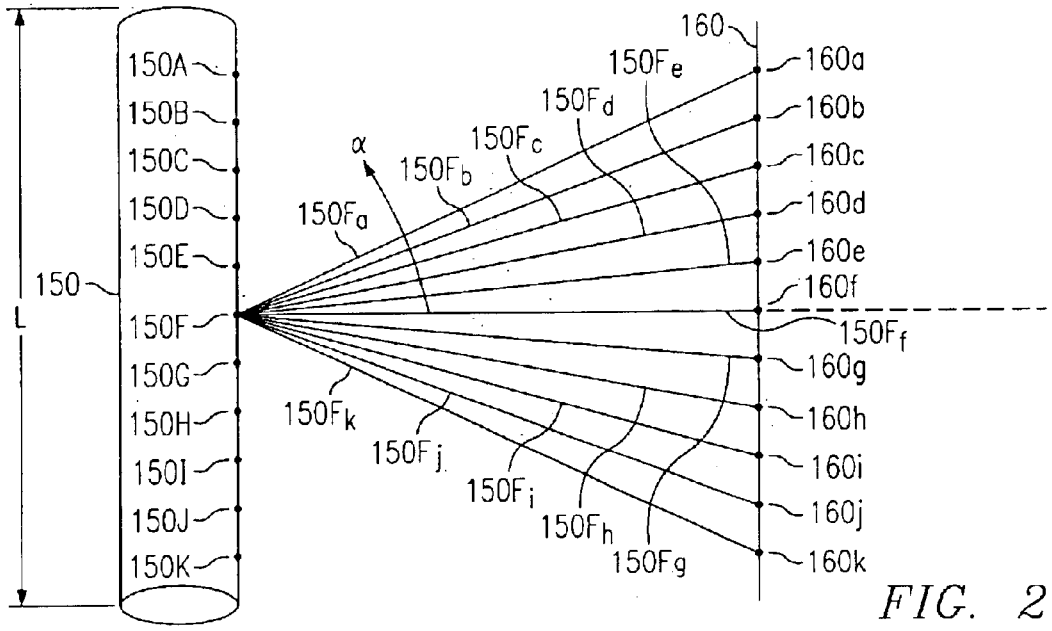
FIG. 2 is a diagram illustrating illumination of a scan object contributed from a single point of an illumination source.

In FIG. 2, there is illustrated an illumination source, for example a CCFL 150, radiating light onto a scan object 160. Scan object 160 is representative of a scan line, for example scan line 10A, of scan media 100. In actuality, CCFL 150 radiates light along a continuous, cylindrical source having collinear endpoints (the terminating ends of CCFL 150). For simplification of discussion, the light radiating from CCFL 150 is considered to originate from a linear source comprised of a finite plurality of point sources 150A–150K colinearly located on CCFL 150.

Light rays are emitted from each point source 150A–150K of CCFL 150 in multi-directions, for example light rays $\mathbf{150}F_a$–$\mathbf{150}F_k$ are emitted from point source 150F. Each point source 150A–150K emits light rays that impinge along scan object 160. Each point source, for example point source 150F, radiates a plurality of light rays that impinge at various points 160*a*–160*k* along scan object 160. The intensity of illumination of any given point 160*a*–160*k* is a function of the distance between the point 160*a*–160*k* and the point source 150A–150K contributing to the illumination of the point 160*a*–160*k*. Specifically, the intensity of illumination provided by a given point source 150A–150K is proportional to $1/r^2$, where $r=d(\cos(\alpha))^{-1}$, d is the distance between the illuminated point 160*a*–160*k* and the illuminating point source, and $\alpha$ is an angle of impingement of the light rays originating from point sources 150A–150K with a particular point 160*a*–160*k*. Thus, the cumulative, or total, illumination intensity is an integral quantity inversely proportional to the square of r. Thus, point 160*f* will have a greater illumination intensity resulting from point source 150F than the illumination intensity of any other points 160*a*–160*e* and 160*g*–160*k* due to the direct, that is perpendicular, impingement of light ray $\mathbf{150}F_f$ with point 160*f*. The illumination intensity for all other points 160*a*–160*e* and 160*g*–160*k* resulting from light radiated from point source 150F will decrease with an increase in the distance therebetween.

Figure 3:
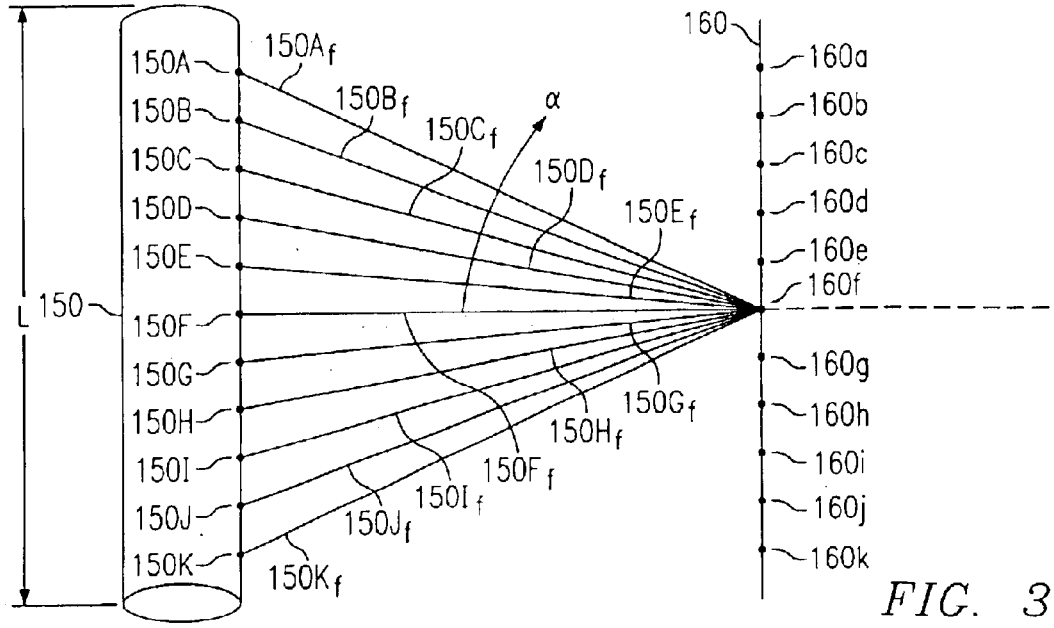
FIG. 3 is a diagram illustrating the cumulative illumination of a midpoint of a scan object resulting from the entirety of the illumination source.

The cumulative illumination of point 160*f* of scan object 160 can be considered to be an integral of the light radiating from along the entirety of point sources 150A–150K. As illustrated in FIG. 3, the total illumination intensity of point 160*f* of scan object 160 is an integral of the illumination contributions from various light rays $\mathbf{150}A_f$–$\mathbf{150}K_f$ originating from along the length of CCFL 150. The collection of light rays $\mathbf{150}A_f$–$\mathbf{150}K_f$ can be considered to include a principal light ray $\mathbf{150}F_f$ impinging on point $\mathbf{160}_f$ perpendicularly therewith, that is principal light ray $\mathbf{150}F_f$ impinges point 160*f* at an impingement angle $\alpha$ of zero, while remaining light rays $\mathbf{150}A_f$–$\mathbf{150}E_f$ and $\mathbf{150}G_f$–$\mathbf{150}K_f$ impinge point 160*f* at various angles of impingement $\alpha$ greater than zero. As mentioned above, a light ray's contribution to the illumination intensity of point $\mathbf{160}_f$ decreases with an increase in the distance between the illumination source and the illuminated point $\mathbf{160}_a$–$\mathbf{160}_k$. Thus, light ray $\mathbf{150}A_f$ provides less radiation to point $\mathbf{160}_f$ than, for example, light ray $\mathbf{150}B_f$.

Figure 4:
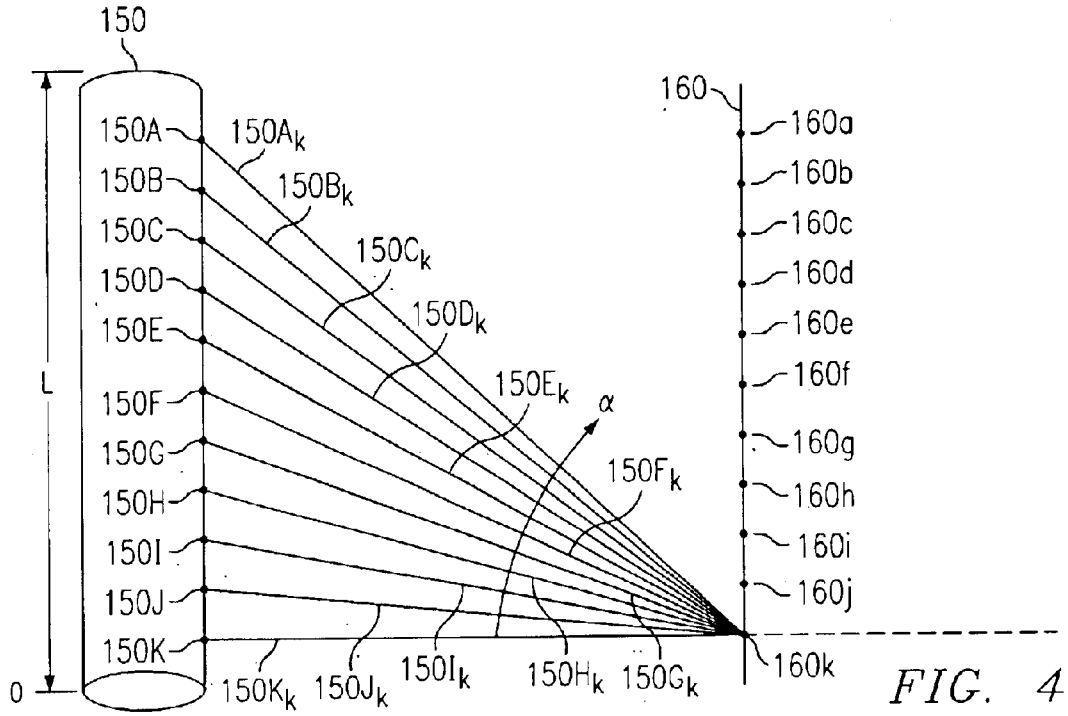
FIG. 4 is a diagram illustrating the cumulative illumination of an endpoint of a scan object resulting from the entirety of the illumination source.
Figure 5A:
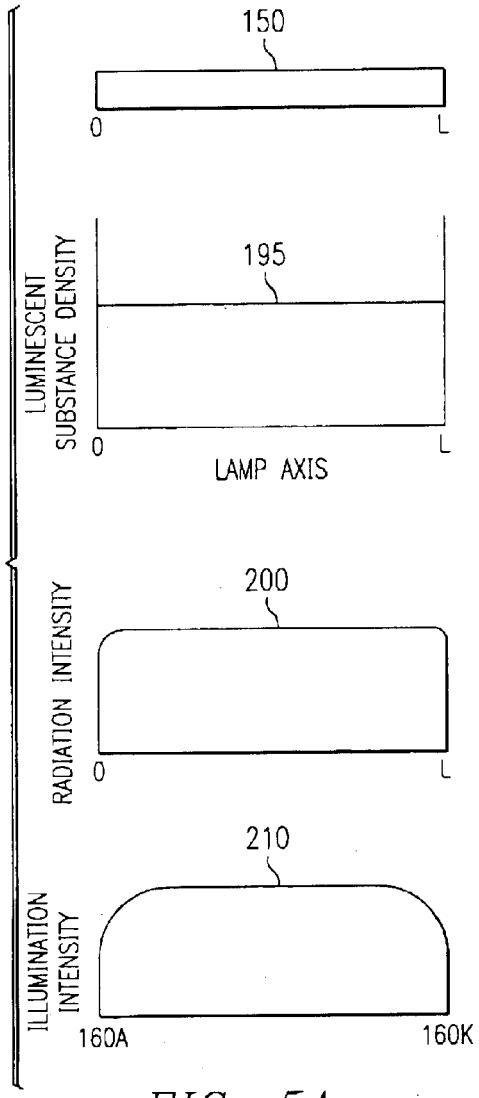
FIG. 5A (PRIOR ART)
FIGS. 5A–5B, respectively, illustrate a radiation profile and a lighting profile of an illumination source having a uniform luminescent substance distribution and a radiation profile and a lighting profile of an illumination source having a typical luminescent substance distribution as is known in the prior art.

If CCFL 150 were an idealized (that is radiating light rays along the length thereof with uniform intensity) and infinitely long light source, each point 160*a*–160*f* would be illuminated with identical intensity. However, because CCFL 150 is finite in length, a non-uniform illumination intensity profile is exhibited along scan object 160 that results in less intense illumination at points near the end of scan object 160. As illustrated in FIG. 4, the light radiating on point 160*k* at a far end of scan object 160 has a principle ray $\mathbf{150}K_k$ having auxiliary rays $\mathbf{150}A_k$–$\mathbf{150}J_k$ originating from only one side of principle ray $\mathbf{150}K_k$. Thus, the illumination intensity of point 160*k* will be less than the illumination intensity of, for example, point 160*f* because the illumination of point 160*k* is, in effect, an integral of point source illuminations over nearly 90 degrees while the illumination of point 160*f* is an integral of point source illuminations over nearly 180 degrees. The result is a non-uniform illumination intensity profile 210 as shown in FIG. 5A. Radiation profile 200 illustrates an approximate radiation profile along the length of the illumination source, for example CCFL 150, having a uniform distribution of a luminescent substance along the surface of CCFL 150. For example, a typical CCFL comprises a sealed glass tube with a luminescent substance, such as phosphor, distributed along the inner surface thereof. A CCFL having a surface with a uniform distribution of a luminescent substance will radiate light of uniform intensity along the length thereof, as illustrated by radiation profile 200. Notably, the radiation profile 200 is a non-integral measurement, that is each point of the radiation profile plot only indicates the intensity of radiation from points (O through L) along the length of CCFL 150 whereas the illumination intensity profile 210 shows the integral effect of illumination at points 160*a*–160*k* of an object being illuminated by an illumination source having radiation profile 200. Points along a midsection of scan object 160 have a greater illumination than points near either of the endpoints, for example points 160*a* and 160*k*, of scan object 160 due to the aforedescribed integral effect of illumination.

The non-uniform illumination intensity profile 210 of the CCFL 150 may also have a secondary cause resulting from a well documented function of the light gathering capability of a typical lens used in image capturing systems. The contributory effect to the non-uniform illumination intensity profile 210 due to the light gathering capabilities of a lens has been shown to be a $\cos^4$ function between the optical path centerline and a line drawn to the relevant area of the image. The overall effect causes an exponential loss of light as the angle increases at the endpoints of the scan object 100. Thus, imaging systems such as scanners that utilize CCFLs suffer from low signal-to-noise ratios at the ends of the scan lines due to decreased light on the scan object, or page, and through the remaining optical system.

Figure 5B:
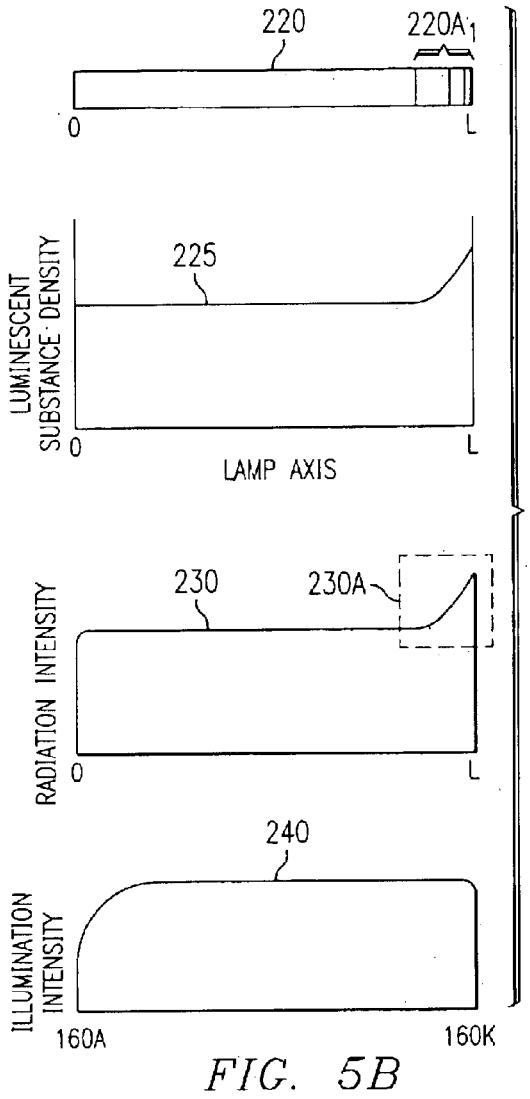
FIG. 5B (PRIOR ART)

The non-uniform illumination intensity profile 210 shown in FIG. 5A results from CCFL 150 having a uniform phosphor, or other illumination substance, coating along the length of CCFL 150, as indicated by a illumination substance density profile 195. However, the phosphor coating is often non-uniform along the length of a CCFL due to non-ideal properties of typical manufacturing techniques. For example, a common manufacturing technique results in a uniform distribution of a luminescent substance around the circumference of the illumination source but also results in a non-uniform distribution of the luminescent substance along the longitudinal axis of the illumination source. In FIG. 5B, there is illustrated a typical CCFL 220 having a non-uniform distribution of an illumination substance on an inner surface thereof as indicated by an illumination substance density profile 225. A section (illustratively denoted by shaded area $\mathbf{220}A_1$) of CCFL 220 has a greater illumination substance density than the remaining portion of CCFL 220. Consequently, the end of CCFL 220 having the greater illumination substance density results in an increased light intensity radiated from that end as illustrated by a skewed region 230A of radiation profile 230. The skewed region 230A results in a counter-effect that offsets the typical loss of illumination near the ends of a scan object due to the described integral effect of illumination. A resulting illumination intensity profile 240 has a more linear plot at the corresponding end and results in a reduction, or elimination, of the required corrective normalization at that end. The present invention advantageously exploits this phenomena. A novel lamp tube treatment process produces a lamp tube having a non-uniform illumination substance distribution that includes a luminescent substance density that is greater at both ends, rather than at a single end, of the tube than at a midsection of the tube—such a tube operable to provide an improved, uniform illumination intensity profile.

Figure 7:
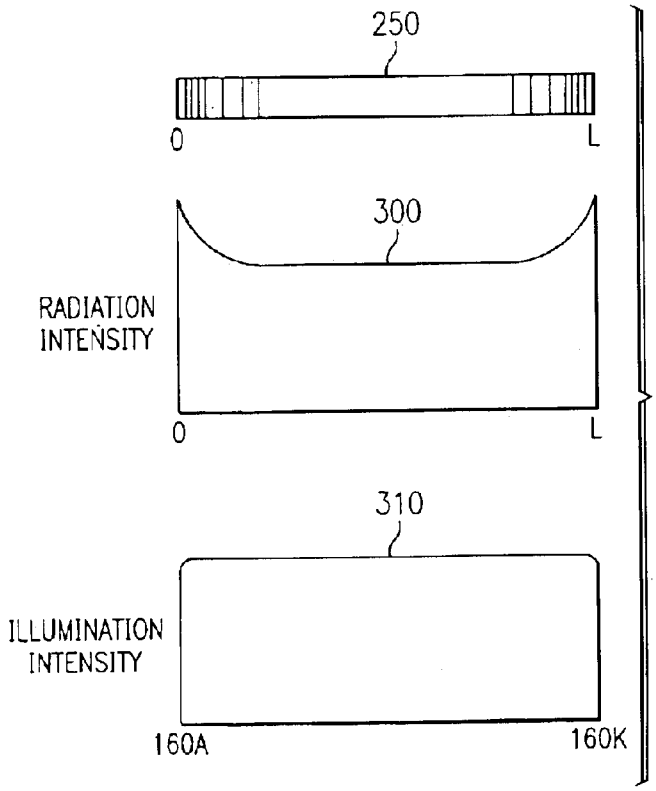
FIG. 7 is a diagram illustrating a radiation profile and lighting profile of an imaging system according to the teachings of the present invention utilizing the illumination source described with reference to FIG. 6.
Figure 6A:
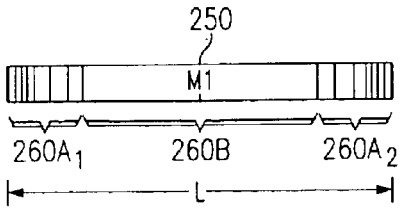
FIGS. 6A–6D illustrate an embodiment of an illumination source according to the present invention, and exemplary luminescent substance density profiles resulting therefrom.
Figure 6B:
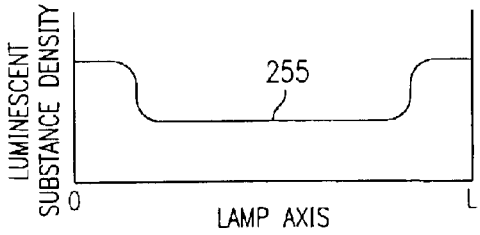
Figure 6C:
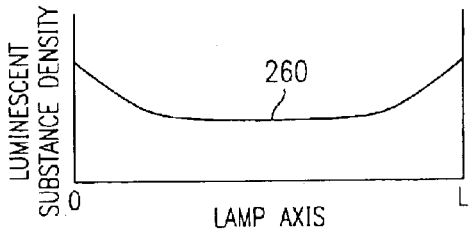
Figure 6D:
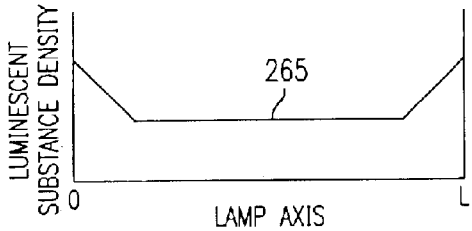

In FIG. 6A, there is illustrated a CCFL 250, or other illumination source, with a novel phosphor, or other luminescent substance, density distribution along the length thereof constructed according to the teachings of the present invention. A midsection 260B of CCFL 250 has a generally constant phosphor density distribution as illustrated by luminescent substance density profile 255 (FIG. 6B). The ends 260$A_1$ and 260$A_2$ of CCFL 250 have a higher phosphor density distribution compared to midsection 260B. While the illustration shows CCFL 250 having areas of two different phosphor densities, it should be understood that ends 260$A_1$ and 260$A_2$ may have a non-constant phosphor density as well. For example, ends 260$A_1$ and 260$A_2$ may have a phosphor density distribution that increases toward the ends of CCFL 250 as illustrated by luminescent substance density profile 260 (FIG. 6C). In fact, midsection 260B may also have a slightly increasing phosphor density distribution from its midpoint (point M1) outward towards sections 260$A_1$ and 260$A_2$ as illustrated by the luminescent substance density profile 265 (FIG. 6D). Thus, CCFL 250 is characterized most generally as having an increasing phosphor density distribution outwardly from a midpoint M1 of CCFL 250 and has a corresponding minimum radiation intensity at the midpoint M1 of CCFL 250. The minimum radiation intensity may be commonly radiated from a portion of CCFL 250 including midpoint M1 and spanning outwardly therefrom towards either (or both) endpoint (O or L) to a point where the radiation intensity increases. The luminescent substance density distribution preferably provides a uniform illumination intensity profile 310, as illustrated in FIG. 7, that results from a non-uniform radiation profile 300. As shown, illumination intensity profile 310 is of approximately equivalent intensity at all points spanning the length of the scan object.

According to the present invention, to achieve uniform illumination intensity profile 310, CCFL 250 preferably provides a non-uniform radiation intensity along the length of CCFL 250, that is the radiation profile 300 is preferably non-uniform to compensate for the integral effects of illumination and/or lens losses as discussed hereinabove. As described with reference to FIG. 6, a non-linear phosphor distribution is used for obtaining an illumination intensity greater near ends 260$A_1$ and 260$A_2$ than along the midsection of CCFL 250. Preferably, the phosphor distribution of CCFL 250 is implemented such that radiation profile 300 is the inverse of illumination intensity profile 210 illustrated in FIG. 5. Illumination with such a light source produces uniform illumination of a scan object by compensating illumination at the ends of a scan object by impinging principle rays thereon that are of greater intensity than principle rays radiated along the midsection of the scan object.

Figure 8A:
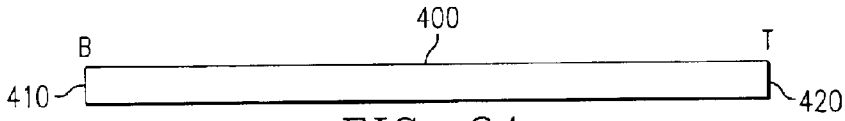
FIGS. 8A–8J illustrate cross-sectional views of a lamp tube undergoing a treatment process for manufacturing the lamp tube with a non-linear luminescent distribution all according to an embodiment of the invention.
Figure 8B:
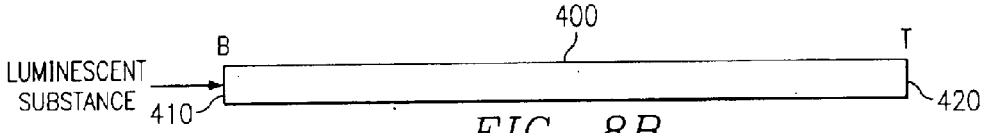
Figure 8C:
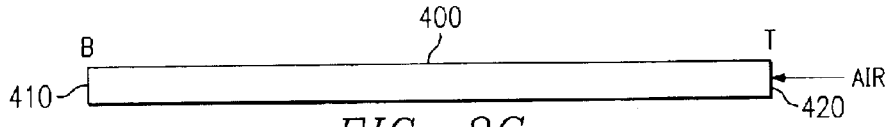
Figure 8D:
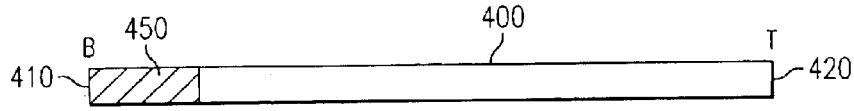

FIGS. 8A–8J, illustrate cross-sectional views of a lamp tube 400 at various stages of a treatment process that results in lamp tube 400 having a non-linear luminescent substance density distribution according to the teachings of the invention. In a first step (FIG. 8A), a lamp tube 400 is loaded into a luminescent substance coating machine. A luminescent substance, such as a phosphor solution, is next introduced into first end 410 of tube 400 (FIG. 8B). Dry air is then introduced into tube 400, for example at a second end 420 of tube 400, to dry the luminescent substance (FIG. 8C). When the luminescent substance is dried, the luminescent substance density distribution generally appears as depicted in FIG. 8D (shaded areas illustratively denoting areas of greater luminescent substance density than non-shaded areas) and includes an area 450 having a high density of the luminescent substance.

To minimize the footprint area of the coating machine, typical manufacturing processes coat luminescent lamp tubes with lamp tube 400 vertically oriented although lamp tube 400 may be positioned at an acute angle as well. In doing so, the luminescent material is often pulled into the tube from a luminescent source located at the bottom (B) or first end 420 of tube 400. For manufacturing simplicity, the drying air is most often injected into second end 420 of tube 400 opposing first end 410, that is the drying air is generally injected into the top (T) end of tube 400. The effect of such a process generally results in a uniform luminescent coating around the circumference of tube 400 but produces a difference in the end-to-end luminescent substance density distribution, that is a non-uniform luminescent substance density distribution along the longitudinal axis of the tube 400. This effect can be seen in FIG. 8D where an area 450 proximate first end 410 has a greater luminescent substance density than the remaining portion of tube 400. The region 450 along tube 400 having a greater luminescent substance density does not generally have a sharp transition but rather is a gradual change in luminescent substance density.

Figure 8E:
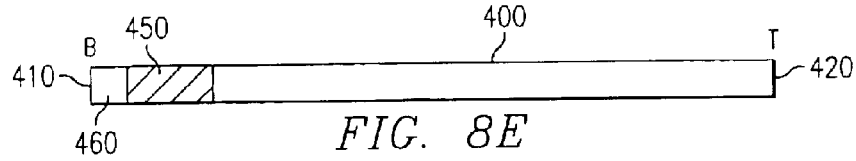
Figure 8F:
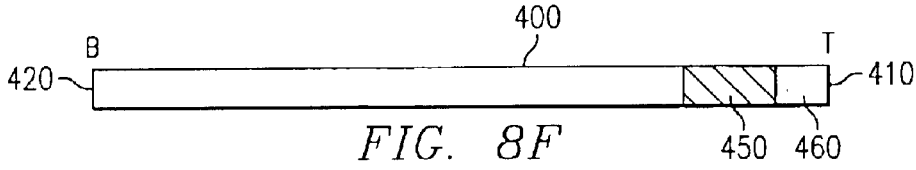
Figure 8G:
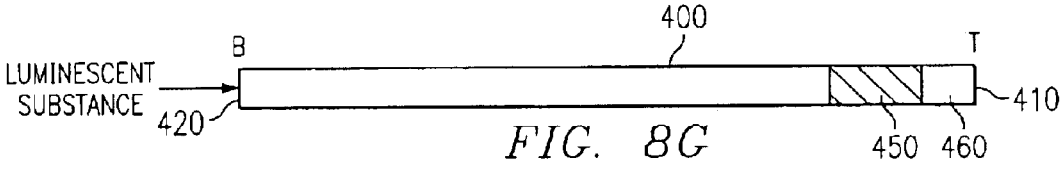
Figure 8H:
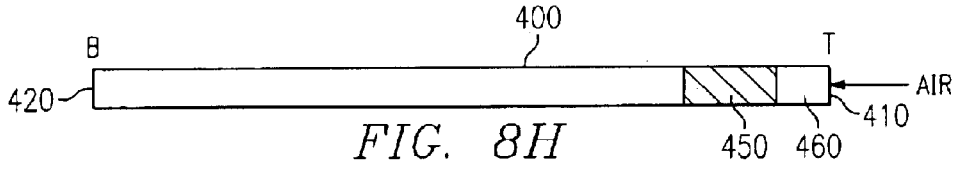
Figure 8I:
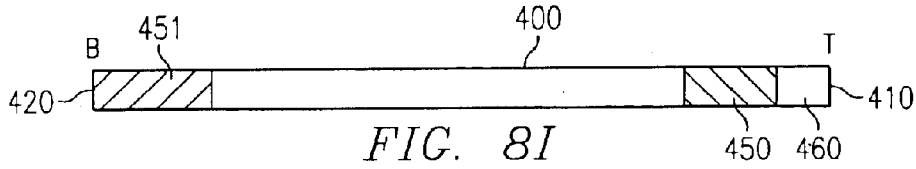
Figure 8J:
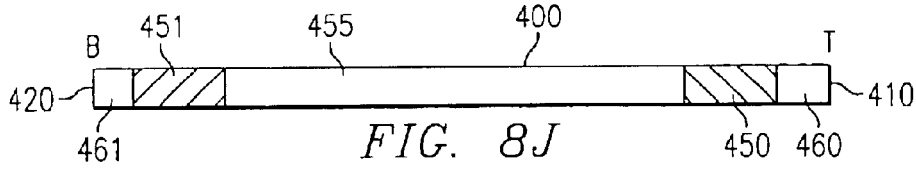

The present invention advantageously exploits the effect of producing a non-uniform distribution of the luminescent substance at the bottom end of tube 400 when treating a tube by reversing the tube (FIG. 8F) orientation within the tube treatment machine and repeating the general procedure described above. After ends 410 and 420 of the tube are reversed (such that end 410 occupies the position originally had by end 420, and vice versa), a predetermined quantity of the luminescent substance, for example a phosphor solution, is next introduced into second, or bottom, end 420 of tube 400 (FIG. 8G). Air is then introduced into tube 400 to dry the luminescent substance (FIG. 8H), for example by injecting, or blowing, dry air into first end 410 (now located at the top (T) position in the treatment machine) of tube 400. The longitudinal distribution of the luminescent substance within tube 400 appears as generally illustrated in FIG. 8I after the luminescent substance has dried. As illustrated, the entry of a second quantity of the luminescent substance and drying thereof in tube 400 after reversing the orientation results in a second area 451 having a high density of the luminescent substance in the end opposite first area 450. A portion 460 of first end 410 of tube 400 may next be cleaned for an internal electrode mount (FIG. 8E). Alternative electrode mounts include external electrode mounts and combination internal and external electrode mounts. A portion 461 of second area 451 may then be cleaned for providing an electrode mount area. Accordingly, tube 400 has areas 450 and 451 proximate ends 410 and 420 that have higher surface densities of luminescent substance than that of a midsection 455 of tube 400.

It may be seen from the foregoing that an illumination source, such as a CCFL tube, having a non-uniform luminescent substance distribution may be produced according to the teachings herein. The illumination source generally includes areas of higher luminescent substance density near the ends of the illumination source. Higher intensity light is thereby radiated from the areas of high luminescent substance density when the tube is used in a lamp for illuminating an object so that a uniform illumination intensity profile may be achieved.

What is claimed is:

1. An illumination source comprising a linear tube having a first end and a second end, the tube having a continuous distribution of a luminescent substance, a first point of the distribution having a luminescent substance density less than each of a second and third point of the distribution, the first point longitudinally located between the second and third points.

2. The illumination source according to claim 1, wherein the luminescent substance density of the second and third points are equivalent.

3. The illumination source according to claim 1, wherein the luminescent substance is phosphor.

4. The illumination source according to claim 1, wherein the tube includes a first electrode mount area and a second electrode mount area, the second point longitudinally located between the first point and the first electrode mount area, the third point longitudinally located between the second point and the second electrode mount area.

5. The illumination source according to claim 1, wherein the illumination source is a cold cathode fluorescent lamp.

6. The illumination source according to claim 1, wherein the illumination source is a xenon lamp.

* * * * *